US006142826A

United States Patent [19]

Bourillon

[11] Patent Number: 6,142,826

[45] Date of Patent: Nov. 7, 2000

[54] SEALED ELECTRICAL CONNECTOR WITH SECONDARY LOCKING MEMBER

[75] Inventor: Philippe Bourillon, Franconville, France

[73] Assignee: The Whitaker Corporation, Wilmington, Del.

[21] Appl. No.: 09/258,896

[22] Filed: Mar. 1, 1999

[30] Foreign Application Priority Data

Mar. 13, 1998 [EP] European Pat. Off. ..... 98400600

[51] Int. Cl.[7] ..... H01R 13/436

[52] U.S. Cl. ..... 439/595; 439/157; 439/271

[58] Field of Search ..... 439/595, 271–275, 439/157

[56] References Cited

U.S. PATENT DOCUMENTS

| | | | |
|---|---|---|---|
| 5,127,854 | 7/1992 | Fujitani et al. | 439/595 |
| 5,328,382 | 7/1994 | Panlicki | 439/595 |
| 5,575,683 | 11/1996 | Saito et al. | 439/595 |
| 5,681,175 | 10/1997 | Busse et al. | 439/157 |
| 5,782,658 | 7/1998 | Maegawa et al. | 439/595 |
| 5,876,226 | 3/1999 | Tsukakoshi et al. | 439/157 |

FOREIGN PATENT DOCUMENTS

| | | |
|---|---|---|
| 0 512 323-B1 | 11/1992 | European Pat. Off. . |
| 0 726 617-B1 | 8/1996 | European Pat. Off. . |
| WO 96/13079 | 5/1996 | WIPO . |

*Primary Examiner*—Gary F. Paumen

[57] ABSTRACT

An electrical connector with coupling assist member and secondary locking member is provided with a seal mounted to the secondary locking member. The secondary locking member has camming protrusions that are cammed below a camming surface of the coupling assist member during transverse sliding thereof, such that the seal is partially compressed prior to full mating with a complementary connector. This also simplifies assembly of the seal in the connector and reduces the number of separate parts to be handled.

8 Claims, 4 Drawing Sheets

SEALED ELECTRICAL CONNECTOR WITH SECONDARY LOCKING MEMBER

BACKGROUND OF THE INVENTION

1. Field of the Invention

This invention relates to a sealed electrical connector having a secondary locking mechanism for locking terminals within cavities of the connector.

2. Description of the Prior Art

It is common in the automotive industry to provide connectors with secondary locking mechanisms that cooperate with primary terminal locking means to ensure that terminals are fully mounted and secured in cavities of the connector housing.

It is also known to provide connectors with coupling assist mechanisms that reduce the forces required by an operator to couple mating connectors, for example with a pivotal lever arm or slide-lock cam mechanism. Such a connector is for example disclosed in European patent EP-B-0 726 617. It is known from EP-B-512 323 to provide a connector with coupling assist member and an end seal. The sealing ring is compressed between a mating face of a mating connector and an end wall of the connector. The connector is however not provided with any secondary locking means.

The provision of secondary locking means complicates a connector housing and introduces cavities and available space for sealing, particularly where the connector is provided with a coupling assist member that also require space and further complicates the connector housing design.

SUMMARY OF THE INVENTION

It is an object of this invention to provide a reliable sealed connector with secondary locking means. It would be advantageous to provide a sealed connector with secondary locking means that enables assembly of the secondary locking means from a mating face of the connector, for example where the secondary locking member has wall portions that back-up integral locking lances in the connector housing that serve as primary locking means for engaging terminals of the connector. It would be advantageous to provide a reliably sealed connector with secondary locking means that is further provided with a coupling assist mechanism. It would be advantageous to provide a sealed connector with secondary locking means that is compact and cost effective, in particular that simplifies assembly of the connector components and reduces the number of parts.

Objects of this invention have been achieved by providing the connector according to the independent claims.

Disclosed herein is a connector comprising a housing with one or more terminals mounted in corresponding cavities of the housing, and a secondary locking member mountable to the housing and adapted to securely lock the terminals in their corresponding cavities when the secondary locking member engages the housing in a fully locked position, the terminals being insertable into the cavities when the secondary locking member is removed from the housing or in a preassembly position engaging the housing, the connector further comprising a sealing member for sealing between the connector and a mating connector to prevent ingress of fluid into the terminal receiving cavities at a mating section of the housing, wherein the seal member is securely attached and mounted on the secondary locking member.

Advantageously therefore, mounting of the seal in the secondary locking provides for a compact sealed connector with few parts and that can be easily assembled. Furthermore, the secondary locking member can be accurately positioned with respect to the housing, and provides the seal with a support that correctly positions and holds the seal member, to ensure that the seal is correctly placed when the connectors are coupled.

The seal member may be in form of an end seal that is resiliently compressed in the direction of mating of the connectors, between a mating face of the mating connector and an end wall of the connector housing. A high pressure compact seal is thus provided. In addition, the end seal may also assist in absorbing vibration between mating connectors.

The seal may be overmoulded and may be bounded by flanges of the secondary locking member and extending in the form of a skirt around the periphery at a lower end thereof, where the secondary locking member is mountable to the connector housing in the mating direction over a mating section of the housing receiving the terminals. The secondary locking member may comprise wall portions that back-up integral resilient locking lances of the connector housing that engage the terminals in the fully inserted position in their cavities, the lances serving as a primary locking means.

The connector may advantageously comprise a coupling assist member, for example a member comprising a camming slide movable in a transverse direction to the mating direction, and comprising camming slots or protrusions engaging complementary camming protrusions or slots of the mating connector for reducing the forces required by an operator to couple the connectors.

The coupling assist member may be provided with a further camming portion engageable with complementary camming portions of the secondary locking member during transverse movement of the coupling assist member from a preassembly position corresponding to the position prior to mating, to the locked position corresponding to the fully coupled position. The camming engagement serves to seat the seal mounted on the secondary locking member firmly in position for engagement with the mating connector.

The secondary locking member may be further provided with a latch member, for example in the form of a protrusion with a locking shoulder, that engages in a complementary latch member for example in the form of a groove or recess with a complementary locking shoulder in the coupling assist member, for preventing movement of the coupling assist member when the secondary locking member is in the preassembled position. The complementary latches disengage when the secondary locking member is moved to the locked position such that the connectors can subsequently be coupled.

Other advantageous features of the invention are set forth in the claims, or will be apparent in the following description and drawings.

DETAILED DESCRIPTION OF THE PREFERRED EMBODIMENT

Figure 1:
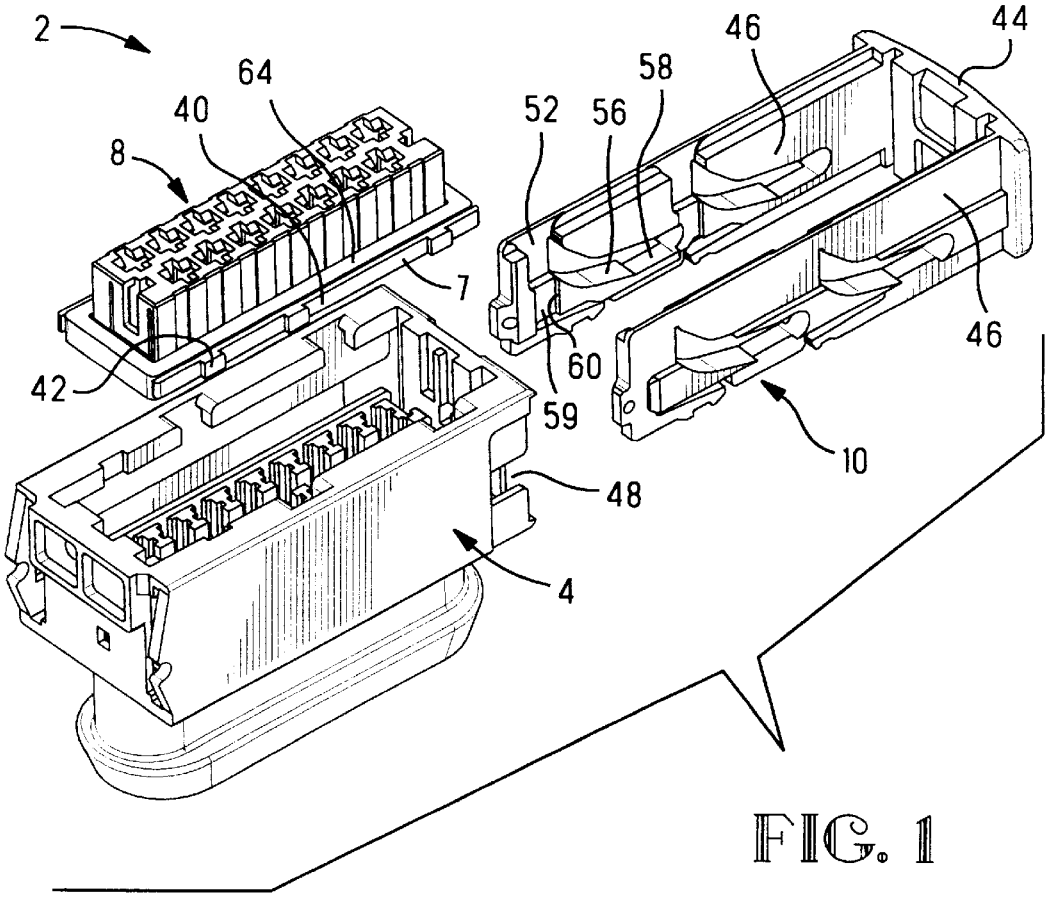
FIG. 1 is an exploded perspective view of a connector according to this invention.
Figure 2:
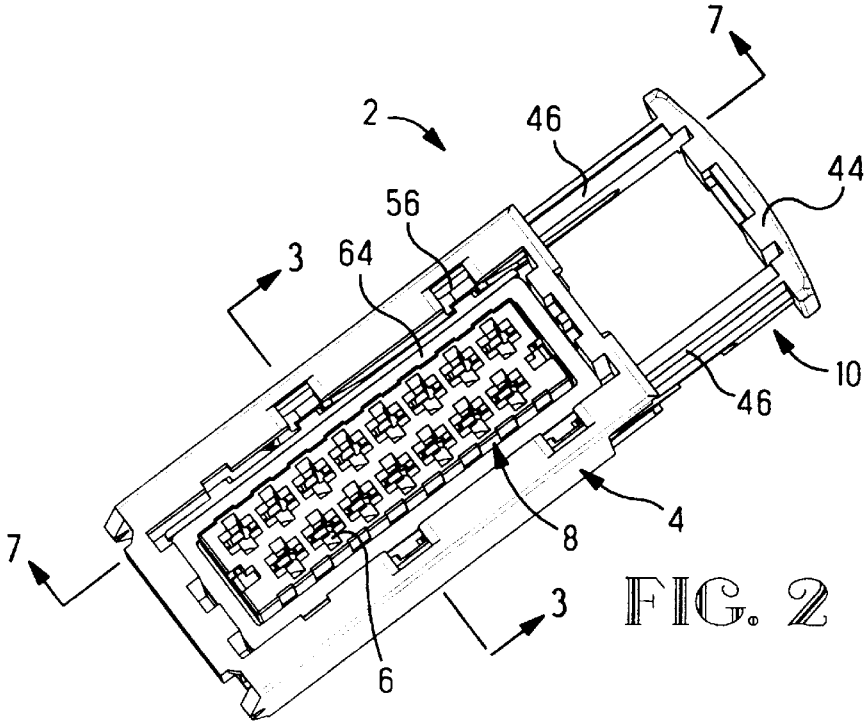
FIG. 2 is a perspective view of the connector according to this invention, viewed towards the mating face thereof.
Figure 3B:
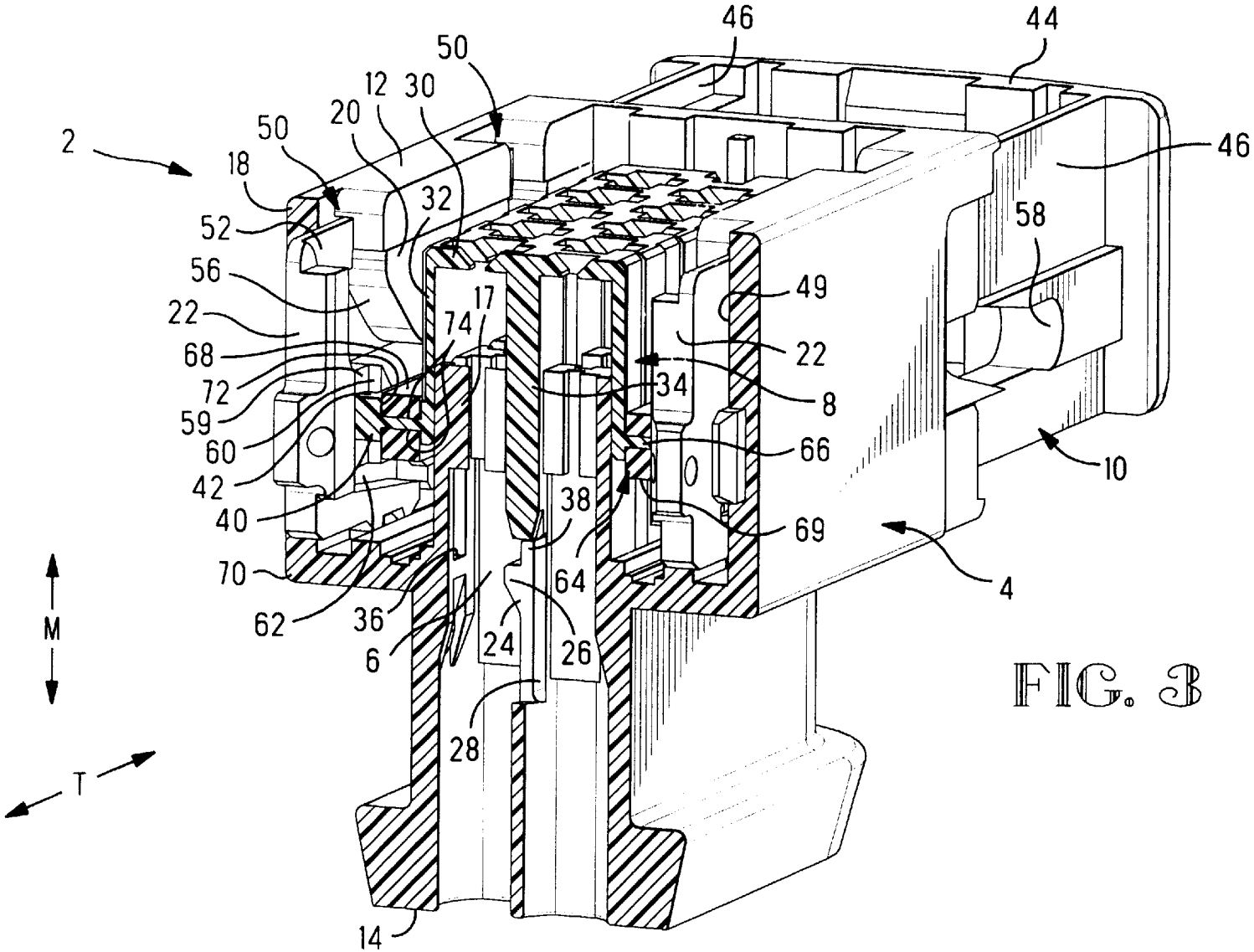
FIG. 3 is a cross-sectional perspective view of the connector taken through line 3—3 of FIG. 2, whereby the secondary locking member is in the preassembly position and the coupling assist member is in the preassembly position.

Referring to all the figures, but mainly FIG. 3, an electrical connector 2 comprises an insulative housing 4 having cavities 6 for receiving electrical terminals therein (not shown), a secondary locking member 8 and a coupling assist member 10.

The housing 4 extends between a mating face 12 and a terminal receiving face 14, the housing having a mating section 17 which is surrounded by a shroud 18 and separated therefrom by a cavity section 20 within which the secondary locking member 8 and arms 22 of the coupling assist member 10 are received. The mating section 17 comprises resilient locking lances 24 integrally moulded therewith, the locking lances 24 in the shape of cantilever beams and having locking protrusions 26 proximate their free ends that project into the terminal receiving cavities 6. Electrical terminals can be inserted into the cavities 6 whereby passage of the terminals past the locking lance protrusions 26 causes resilient outward biasing of the locking lances until engagement of the protrusions 26 behind shoulders of the terminals to prevent removal of the terminals from their corresponding cavities. Adjacent locking lances of an adjacent row of cavities are separated by a slot 28 to allow outward biasing of the lances during mounting of the electrical terminals within their corresponding cavities.

Figure 4:
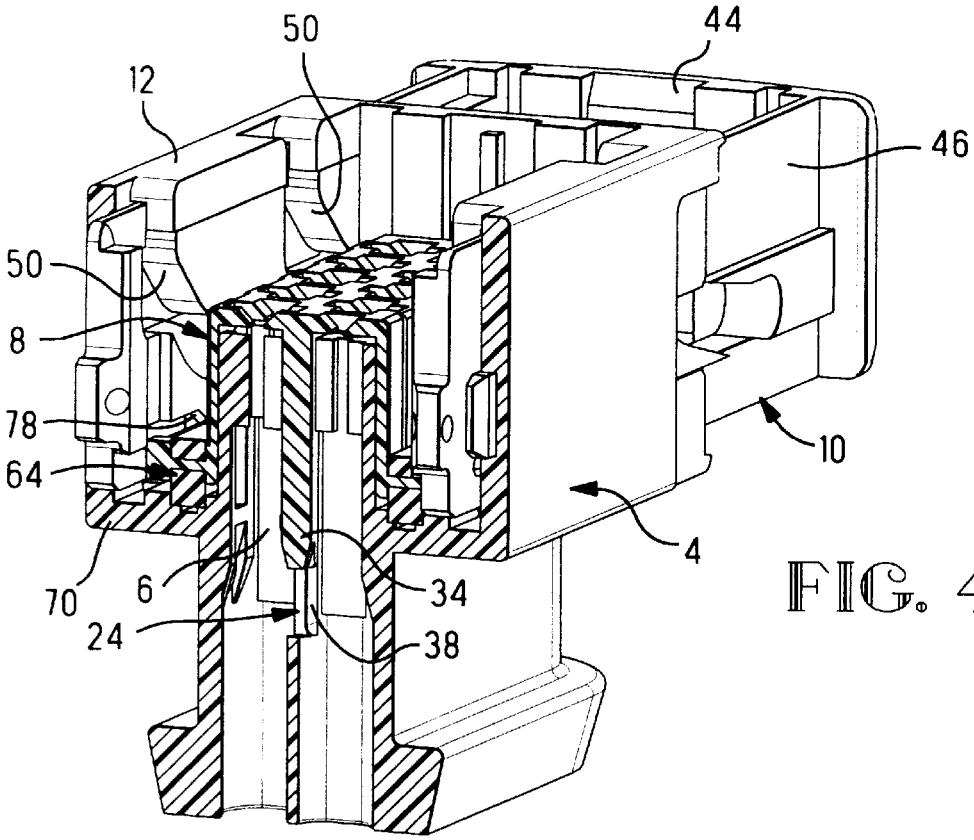
FIG. 4 is a view similar to FIG. 3 except that the secondary locking member is in the locked position.
Figure 5:
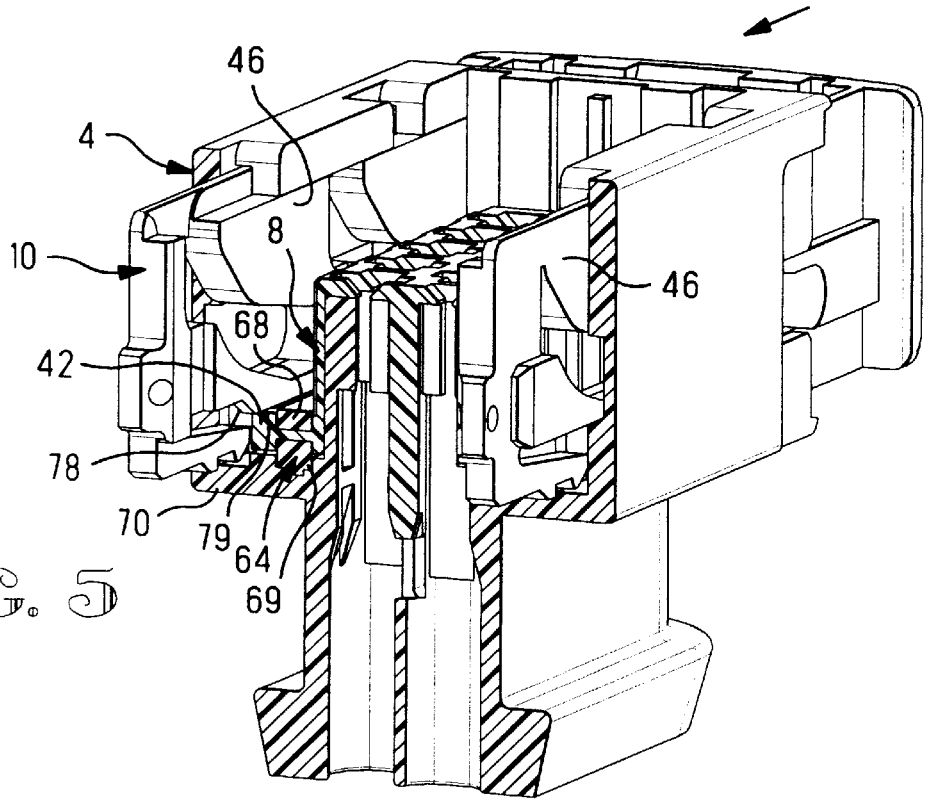
FIG. 5 is a view similar to FIG. 4 except that the coupling assist member is between the preassembly and fully coupled positions.

The secondary locking member 8 comprises a mating end wall 30 and extending therefrom a shroud 32 that fits over the mating end of the housing mating section 17. Also extending from the mating end wall 30 are locking wall portions 34 that are positioned adjacent outer surfaces 38 of the locking lances 24 when the secondary locking housing 8 is in the fully locked position, as shown in FIG. 4. The wall portions 34 prevent outward biasing of the locking lances 24 in order to securely lock the terminals that have been inserted into the cavities 6 and that have engaged with the locking protrusions 26 of the locking lances 24. The housing cavities 6 may be further provided with locking shoulders 36 for engagement by resilient locking lances formed on the terminals, which form an optimal additional means of securing the terminals in their cavities.

In FIG. 3, the secondary locking housing 8 is shown in the preassembly position whereby the wall portions 34 are disengaged from the locking lances' outer surfaces 38 such that the locking lances are free to bias outwardly for reception of terminals within their cavities 6. The secondary locking housing is held in the preassembly position by a latching means (not shown) which maintains the member 8 in the preassembly position, the secondary locking member however being depressible under application of a certain force for snapping into the fully locked position as shown in FIG. 4 where the latch means securely hold the secondary locking member in this position.

The secondary locking member 8 further comprises a latch member in the form of a protrusion 42 attached to a lower portion 40 of the shroud 32 and extending in a direction perpendicular to the mating or coupling direction (M) of the connector. The latch member engages a complementary latching shoulder of the coupling assist member when the secondary locking member is in the preassembly position, as will be described in more detail below.

Figure 6:
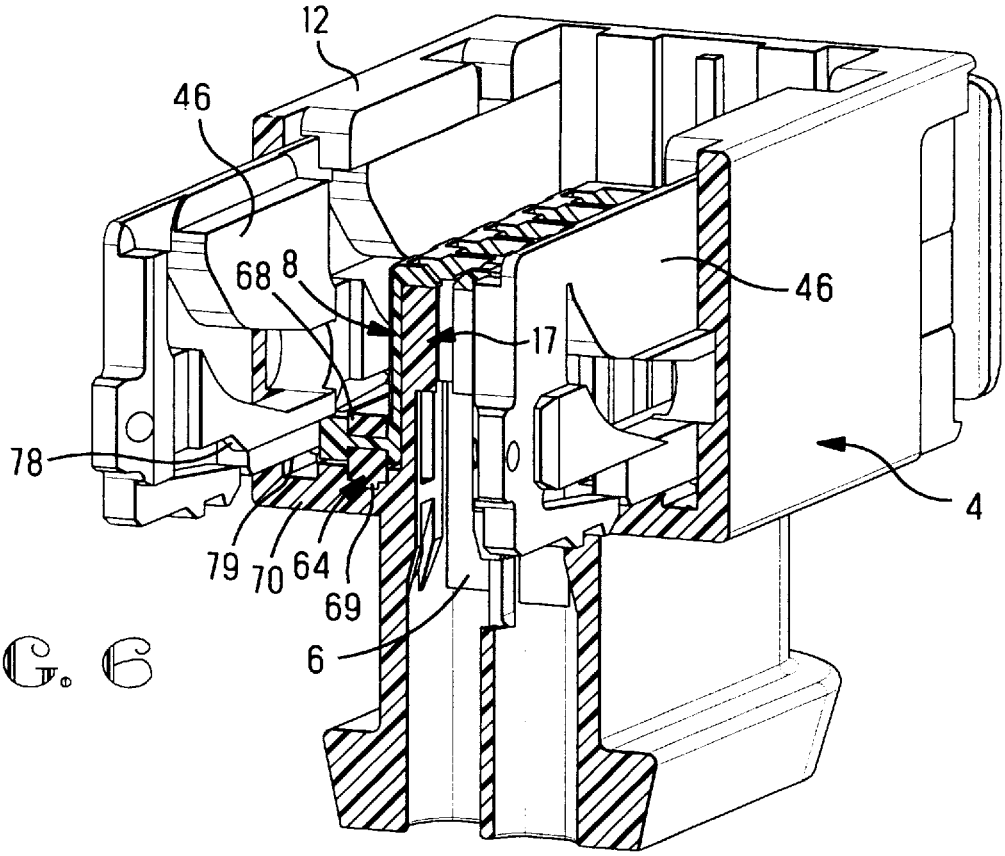
FIG. 6 is a view similar to FIG. 5 except that the coupling assist member is shown in the fully locked position.

The coupling assist member 10 comprises a U-shaped body having a base wall 44 and side walls 46 extending laterally therefrom, the side walls 46 insertable through cutouts 48 in the connector housing shroud 18 to slide adjacent an inner surface 49 of the shroud side walls. The coupling assist member side walls 46 comprise camming slots 50 that have an entry portion 52, extending from the mating face 12, the entry portion 52 extending into an oblique portion 56 which then extends into an end portion 58 orthogonal (T) to the mating direction (M). The camming slots 50 are for receiving studs of a complementary connector (not shown), in order to draw the complementary connector towards the connector 2 when the coupling assist member 10 is moved from the open position as shown in FIG. 4 to the closed position as shown in FIG. 6. The latter thus causes coupling of the connector 2 to the complementary connector. Before sliding from the open to the closed position, the coupling assist member 10 receives the studs of the complementary connector first into the entry portion 52 of the camming slot 50, which allows initial engagement of the connector to the complementary connector. If the coupling assist member 10 is in the closed position prior to coupling to the complementary connector, the studs of the complementary connector cannot enter into the camming slot entry portion 52 and simply abuts the mating end of the side walls 46, thus preventing coupling of the connectors. The end portions 58 of the camming slots 50 engage the complementary connector studs when the coupling assist member 10 is in the fully closed position, and due to the orthogonal transverse direction (T) of the end portion 58 with respect to the coupling direction (M) of the connectors, a force tending to pull apart the connectors will not produce a force component in the orthogonal direction and thus cannot open the coupling assist member and release the connectors from the mating position.

The coupling assist member 10 further comprises a complementary latch member in the form of a recess or groove 59 with a locking shoulder 60 on the inner surface of the side walls 46, against which latching protrusions 42 of the secondary locking member engage, when in the preassembly position as shown in FIG. 3. During assembly of the terminals into the housing cavities 6, the secondary locking member 8 is in the preassembly position and the coupling assist member 10 is in the open preassembly position as shown in FIG. 3, whereby the protrusions 42 engage with the shoulder 60. The coupling assist member 10 can thus not be moved into the closed position and can therefore not be coupled to a complementary connector.

When the secondary locking member 8 is moved from the preassembly position shown in FIG. 3 to its fully locked position shown in FIG. 4, the locking protrusion 42 disengages from the shoulder 60 and moves into the area 62 below the side walls 46. The coupling assist member is then free to slide transversely and the connector 2 can thus be coupled to the complementary connector.

The system described above is also applicable to a circular connector, where the coupling assist member is ring shaped and rotates during coupling. Such a coupling assist member could for example be mounted to the connector housing shroud by insertion from the mating end, where the side walls 46 would be replaced by a cylindrical member insertable adjacent the inner surface of the connector housing shroud.

The connector 2 further comprises a seal member 64 that is in this embodiment made of an elastomeric material that is mounted on the secondary locking member 8. In this embodiment, the seal member 64 is moulded over a plurality of discreet tabs 66 forming part of the lower portion 40 of the secondary locking housing and projecting orthogonally with respect to the mating direction (M). The seal could be mounted to the secondary locking member in other manners, for example by bounding, or merely engaging fixing tabs having hooks or some form of latching means that secure the seal member to the secondary locking housing. The seal member 64 is provided with upper and lower sealing portions 68, 69 that abut respectively a mating face of the mating connector and an end wall 70 of the housing 4, the end wall 70 extending between the housing mating section 17 and shroud outer wall 18. The seal member 64 is thus compressed in the mating direction (M) when the connectors are fully coupled, thereby sealing the mating section 17 from the external environment.

It is also possible to provide the seal member 64 in the form of a radial seal that is compressed between the connectors in a direction orthogonal (T) to the mating direction (M), however the present embodiment is preferred for high pressure sealing, or where a particularly compact sealed connector arrangement is preferred. A radial sealing member would for example be mounted on the secondary locking member side wall 32 and have radial sealing lips that seal between the housing mating section 17 and the complementary connector.

Advantageously, because the seal member 64 is mounted to the secondary locking member, it does not need to be separately mounted to the housing and held and positioned therein by portions of the housing. By mounting the seal member on the secondary locking member there are few parts to be assembled, and accurate support and location of the seal in the housing is provided by guiding of the secondary locking member with respect to the mating section. The secondary locking member is easily assembled to the housing from the mating face 12 of the connector, and therefore also provides an easy assembly of the seal member in the connector despite, for example, provision of a narrow space 20 in the connector.

The lower portion 40 of the secondary locking member may further comprise a skirt 72, which is joined to the secondary locking member via the tabs 66, and that provides a recess or recesses 74 within which the upper and lower seal portions 68, 69 are seated. The skirt 72 is also provided with the latch members 42 in the form of protrusions, which extend therefrom and serve to secure the coupling assist member 10 when the secondary locking member not in the fully position, as already described hereinabove.

Figure 7:
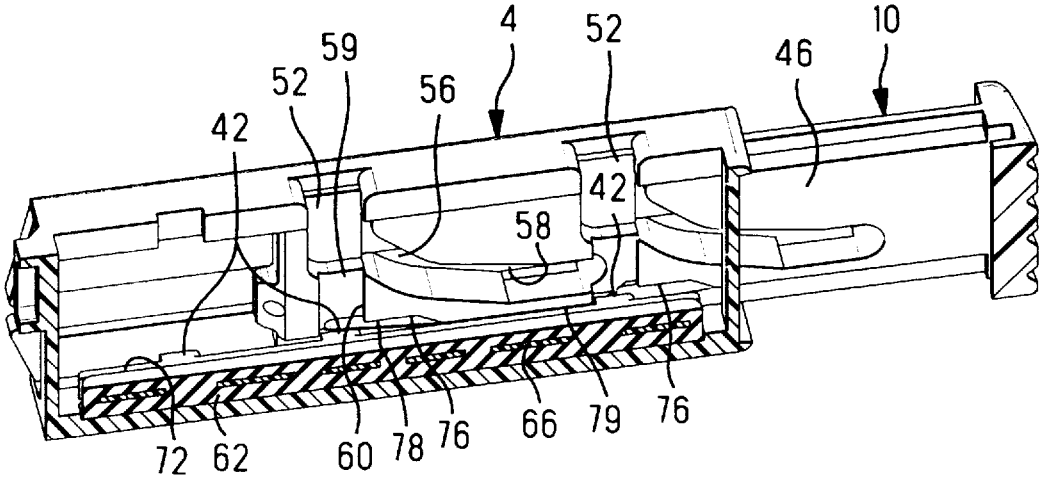
FIG. 7 is a perspective cross-sectional view through line 7—7 of FIG. 2.

The protrusions 42 have a further function, in that they serve as camming portions that engage a lower complementary camming surface 76 (see FIG. 7) formed on a lower end of the coupling assist member side walls 46. The camming portions 42, 76 are disengaged when the coupling assist member is in the preassembly position, and engage when the coupling assist member is transversely move to the fully coupled position. The camming surfaces 76, 42 move the secondary locking member 8 towards the housing end wall 70 thereby compressing the seal lower portion 69 therebetween. This ensures that the end seal takes an accurately defined position prior to abutment of the mating connector thereagainst, and also advantageously ensures that part of the force required for compressing the seal occurs prior to full coupling, thereby distributing the forces required by an operator during coupling. The coupling assist member cam surfaces 76 are provided with a tapered lead-in portion 78 and a transverse portion 79 extending in the transverse direction (T) orthogonal to the mating direction (M), such that the complementary camming members 42 are gradually cammed below the surface 79 which defines the final compressed position. Whereas in this embodiment the camming members 42 of the secondary locking member also act as latch members for blocking the coupling assist member 10, it is possible to provide separate members each performing their own function.

Advantageously therefore, a compact and effectively sealed connector is provided, that is easy to assemble.

Using the teaching of the invention described hereinabove, it would also be possible to provide the seal member on a housing support that is separately manufactured from the secondary locking member and assembled against the end wall 70 and cammed in to the compressed position in a manner similar to the embodiment described above, whilst retaining the advantages of accurate positioning of the seal member, and reduction of peak forces required by an operator, by partially compressing the seal member with the cooperating cams 76, 42 prior to full coupling.

I claim:

1. A connector comprising a housing with one or more terminals mounted in corresponding cavities of the housing, and a secondary locking member mountable to the housing and adapted to securely lock the terminals in their corresponding cavities when the secondary locking member engages the housing in a fully locked position, the terminals being insertable into the cavities when the secondary locking member is removed from the housing or in a preassembly position engaging the housing, the connector further comprising a sealing member for sealing between the connector and a mating connector to prevent ingress of fluid into the terminal receiving cavities at a mating section of the housing, wherein the seal member is securely attached and mounted on the secondary locking member, the connector further comprising a coupling assist member for reducing the forces required by an operator to couple the connector with the mating connector, the coupling assist member comprising a camming surface engaging complementary camming portions of the secondary locking member during movement of the coupling assist member from the preassembly position, where the connectors can be initially coupled, to a fully coupled position where the connectors are fully mated together, such that the seal member is partially compressed.

2. The connector of claim 1 wherein the seal member is in the form of an end seal resiliently compressible in a mating direction of the connectors.

3. The connector of claim 1 wherein the seal member is secured to the secondary locking member by moulding thereof over a portion of the secondary locking member.

4. The connector of claim 1 wherein the coupling assist member is in the form of a slide with camming slots or protrusions for engaging complementary camming studs or slots of a mating connector, the coupling assist member slidably moveable in a transverse direction substantially orthogonal to a direction of mating of the connectors.

5. The connector of claim 4 wherein the secondary locking member camming surface of the coupling assist member is provided proximate a lower end of one or more side walls of the coupling assist member, the lower end arranged remote from a mating face of the connector.

6. The connector of claim 1 wherein the secondary locking member is mountable to the connector housing from a mating face thereof, and is moveable from the preassembly position to the locked position substantially in a direction of mating of the connectors.

7. The connector of claim 1 wherein the secondary locking member is mountable to a mating section of the housing, the housing further provided with a shroud surrounding the mating section and separated therefrom by a gap, and wherein the shroud is interconnected to the mating section via an end wall.

8. The connector of the claim 7 wherein the seal member is compressible against the end wall.

* * * * *